US006609625B1

(12) United States Patent
Gibbar

(10) Patent No.: US 6,609,625 B1
(45) Date of Patent: Aug. 26, 2003

(54) DRINK VESSEL HOLDER

(76) Inventor: James M. Gibbar, 110 W. Brittany La, O'Fallon, IL (US) 62269

( * ) Notice: Subject to any disclaimer, the term of this patent is extended or adjusted under 35 U.S.C. 154(b) by 16 days.

(21) Appl. No.: 10/078,104

(22) Filed: Feb. 19, 2002

(51) Int. Cl.[7] ..... B65D 21/02; A47G 23/06
(52) U.S. Cl. ..... 220/574; 220/737; 248/311.2
(58) Field of Search ..... 220/574, 23.86, 220/738, 739, 737; 248/311.2

(56) References Cited

U.S. PATENT DOCUMENTS

| | | | | |
|---|---|---|---|---|
| D45,254 | S | 2/1914 | Dulton | |
| 1,943,698 | A | 1/1934 | Schurmann | 229/2.5 |
| 2,107,023 | A | 2/1938 | Bertsch | 65/15 |
| 2,107,381 | A | 2/1938 | Leppke | 65/15 |
| 2,174,586 | A | 10/1939 | Leppke | 65/15 |
| 2,210,283 | A | 8/1940 | Cowan | 65/15 |
| 2,677,350 | A | 5/1954 | Prestidge et al. | 119/61 |
| 2,700,284 | A | 1/1955 | Lyon, Jr. | 65/15 |
| 3,121,507 | A | 2/1964 | Weiss | 220/23.8 |
| 3,401,858 | A | 9/1968 | White et al. | 224/48 |
| 3,942,671 | A | 3/1976 | Florian | 220/23.8 |
| 3,955,672 | A | 5/1976 | Brundage | 206/72 |
| 4,219,144 | A | 8/1980 | Hagelberg | 229/2.5 R |
| 4,461,396 | A | 7/1984 | Harper | 220/23.83 |
| 4,732,274 | A | 3/1988 | Bouton | 206/561 |
| 4,823,958 | A | 4/1989 | Mahmud | 206/561 |
| 4,867,331 | A | 9/1989 | Task | 220/238 |
| 4,938,373 | A | 7/1990 | McKee | 220/23.86 |
| 4,966,297 | A | 10/1990 | Doty | 220/23.83 |
| 5,060,820 | A | 10/1991 | Boerner | 220/574 |
| 5,249,700 | A | 10/1993 | Dumke | 220/574 |
| 5,259,528 | A | 11/1993 | Pace et al. | 220/575 |
| 5,323,910 | A | 6/1994 | van de Graaf, Jr. | 206/557 |
| 5,335,787 | A | 8/1994 | Finchum et al. | 206/564 |
| 5,353,952 | A | 10/1994 | Donche | 220/575 |
| 5,361,932 | A | 11/1994 | Friedrich | 220/574 |
| 5,421,459 | A | 6/1995 | Mazzotti | 206/549 |
| 5,441,164 | A | 8/1995 | Beck et al. | 220/575 |
| D366,817 | S | 2/1996 | Sampson | D7/701 |
| 5,853,104 | A | 12/1998 | Rathjen | 220/574 |
| 5,947,011 | A | 9/1999 | Xu | 99/357 |
| 5,960,982 | A | 10/1999 | Perlis et al. | 220/574 |
| 5,971,139 | A | 10/1999 | Bradley | 206/217 |

*Primary Examiner*—Joseph M. Moy
(74) *Attorney, Agent, or Firm*—Peter Loffler

(57) ABSTRACT

A drink vessel holder holds a drink vessel therein and allows a user to hold a plate of food and a drink vessel that is held within the drink vessel holder with the drink vessel holder resting on the plate and the user holding both the plate and the drink vessel holder with the same hand in order to allow the other hand to be used for enjoyment of the products being held. The drink vessel holder has a base member and a wall, which is generally arcuate in shape and is comprised of either a generally solid wall extending from one side of a slit to the other or is a plurality of fingers that extend between the two sides of the slit. An extension extends outwardly from the wall proximate the bottom of the base at the bottom of the slit, the top surface of the extension being generally concave for receiving a thumb of the user for holding the drink vessel holder on the upper surface of the plate.

13 Claims, 4 Drawing Sheets

DRINK VESSEL HOLDER

BACKGROUND OF THE INVENTION

1. Field of the Invention

The present invention relates to a device that holds a drink vessel which can rest on a plate allowing the user to maintain the items placed on the plate and the drink vessel holder with one hand.

2. Background of the Prior Art

Most parties and other similar social occasions serve both food and drink. Obviously, the food is placed onto a plate while the drink is held within a drink vessel such as a cup, a can, or a glass. This very straightforward method, while very efficient in its containment performance, does have its drawbacks.

If the social occasion is such that food and drink are retrieved from one or more central serving stations, and upon retrieval of the bounty, the user returns to a seat at a table, the separate plate and drink vessel tend to be satisfactory for most such occasions. The problem arises when it is desired that the party attendee not return to a table for consumption of the food and drink being served. Such lack of desired destination can occur when the party host lacks sufficient sit down facilities to accommodate all of the guests. More typically, it is the host's desire to keep the attendees on their feet in order to keep such attendees moving in order to facilitate dynamic guest interaction.

As the guest must hold the food filled plate with one hand and the drink vessel with the other, this desire to keep a large portion of the guests on their feet at any given time, presents some problems. Although sipping a drink presents few problems, having both hands full makes the consumption of the food on the plate a tricky occurrence. The guest may sit at a table to consume both food and drink in relative comfort. However, either by necessity or by design, the availability of sitting locations may be at a premium, and many guests do not want to sit and want to mingle even while eating and drinking. The guest may find a location, such as a table, onto which either the plate or the drink vessel may be placed, thereby freeing one hand allowing for proper maneuverability between plate and drink vessel. However, this may also be problematic due to the limited availability, either by necessity or by design, of such rest areas available to the guest. Furthermore, this method also tends to tie down the guest although not necessarily as much as sitting at a table. Another method to overcome the problem of having both hands full, is for the guest to retrieve their food or drink initially, and upon consumption of the initial item, to retrieve the other item in order to consume food and drink in sequential fashion. While this method will work as planned, most guests desire to have a drink during, as opposed to before or after, food consumption. Additionally, this arrangement throws into disarray parties that are designed for the intermingling of food and drink such as wine and cheese parties or beer and pretzel parties.

One other method employed by many guests is to attempt to hold the food plate and the drink vessel with one hand and to use the other hand to facilitate enjoyment of the consumables. While many guests may prove to be quite adept at succeeding with such maneuverability, other guests will proceed with disastrous and embarrassing results.

In order to facilitate the ability of a guest to be able to enjoy food and drink simultaneously without the need to sit at a table or to place either the food bearing plate or the drink vessel onto a fixed surface and without the need to perform heroic acrobatics, combined plate and drink vessel holders have been proposed. Such prior art devices are designed to serve as a plate in order to hold food and are also designed to hold a drink vessel so that a user can hold the food bearing plate and drink vessel with one hand so that the other hand may facilitate the enjoyment of the food and drink. Such prior art devices come in a variety of designs and work with varying degrees of efficiency, however, they tend to suffer from one or more drawbacks.

Many such food plate and drink vessel holding devices perform their intended task with great efficiency, yet such devices are unduly complex in design and construction, making such devices unusually expensive to employ. Other prior art devices have the ability to hold only a specific type of drink vessel, making the utility of such devices limited in many situations. Still other devices require certain steps to be taken for proper device usage, rendering such devices awkward in operation with the potential for device failure and the attendant embarrassment that results.

Therefore, there exists a need in the art for a device that serves as a drink vessel holder which can be used with any plate, overcoming the above mentioned problems found in the art. Specifically, such a device must be of relatively simple and straightforward design and construction and must be relatively easy to manufacture. Such a device must be able to accommodate a large variety of drink vessels that are commonly found at parties. Use of such a device must be quick and easy and the chance for potential disaster during device usage must be relatively small.

SUMMARY OF THE INVENTION

The drink vessel holder of the present invention addresses the aforementioned needs in the art. The drink vessel holder is a device that allows a user to hold a plate of food and a drink vessel with the same hand so that the other hand may be employed to enjoy the food and drink being held. The drink vessel holder is of relatively simple and straightforward design and construction and is relatively easy to manufacture employing standard manufacturing techniques. The drink vessel holder is able to accommodate a large variety of drink vessels that are commonly found at parties. Use of such a drink vessel holder is quick and easy rendering the chance for potential disaster during device usage relatively small.

The drink vessel holder of the present invention is comprised of a vessel holding member that has a base with a top and a bottom and a wall having an inner periphery, an outer periphery, and a slit. An extension is attached to the base and extends outwardly from the outer periphery between end edges of the wall. The vessel holding member receives an appropriate drink vessel therein such that the drink vessel sits on the top of the base, and the base of the vessel holding member rests on a plate such that a person can hold the plate while abutting a thumb against the extension for holding the vessel holding member securely on the plate. The extension has a top surface that is generally concave for comfortably receiving the thumb of the user. The wall is generally arcuate in shape and is either a generally solid body extending from between a first side of the slit and a second side of the slit or is comprised of a plurality of fingers extending upwardly from the top of the base, wherein each of the plurality of fingers is resilient. The wall may taper inwardly extending from its top to the base. If placed fixedly on the plate, the vessel holding member may be positioned on the plate off of the center of the plate.

BRIEF DESCRIPTION OF THE DRAWINGS

Similar reference numerals refer to similar parts throughout the several views of the drawings.

DESCRIPTION OF THE PREFERRED EMBODIMENT

Figure 1:
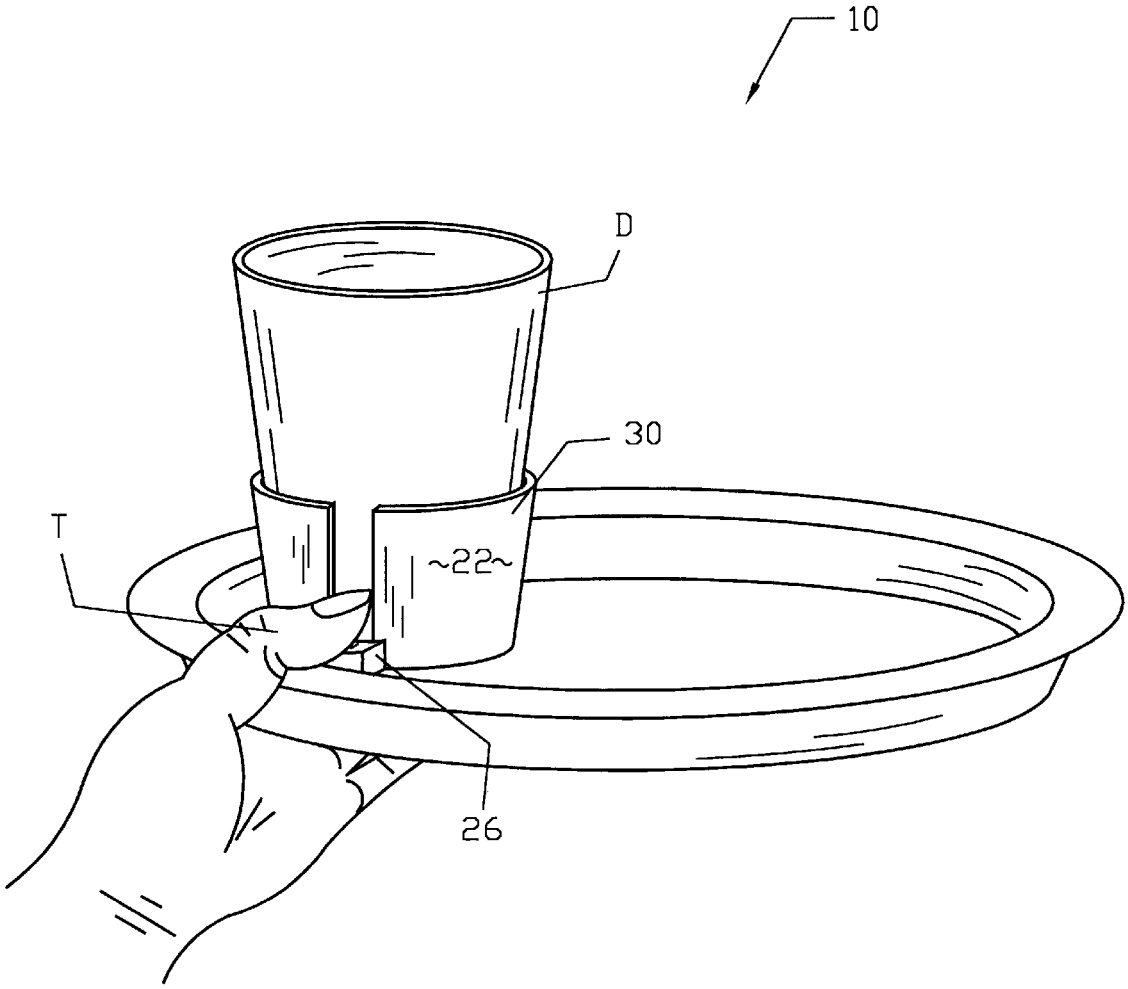
FIG. 1 is an environmental view of the drink vessel holder being used by a party attendee.
Figure 3:
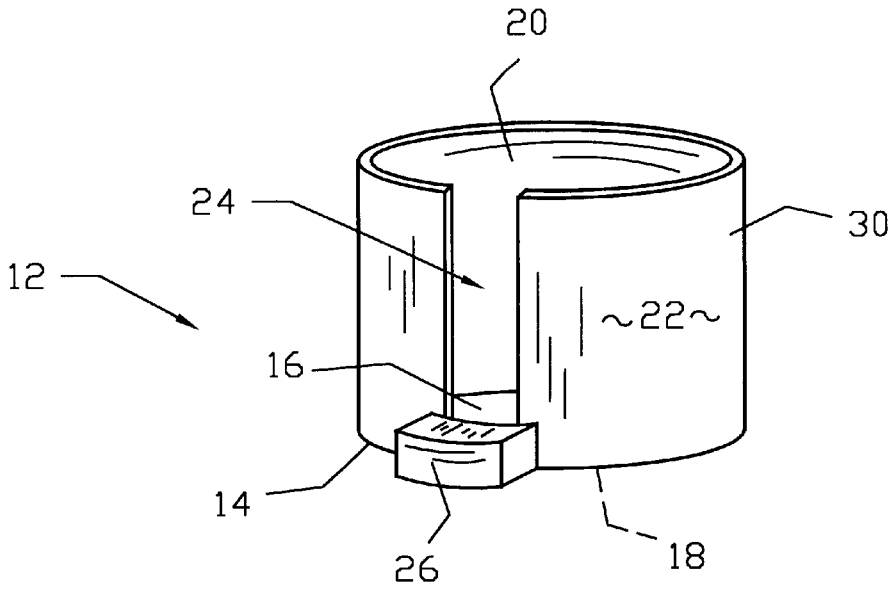
FIG. 3 is a close-up perspective view of the drink vessel holder of FIG. 2.
Figure 2:
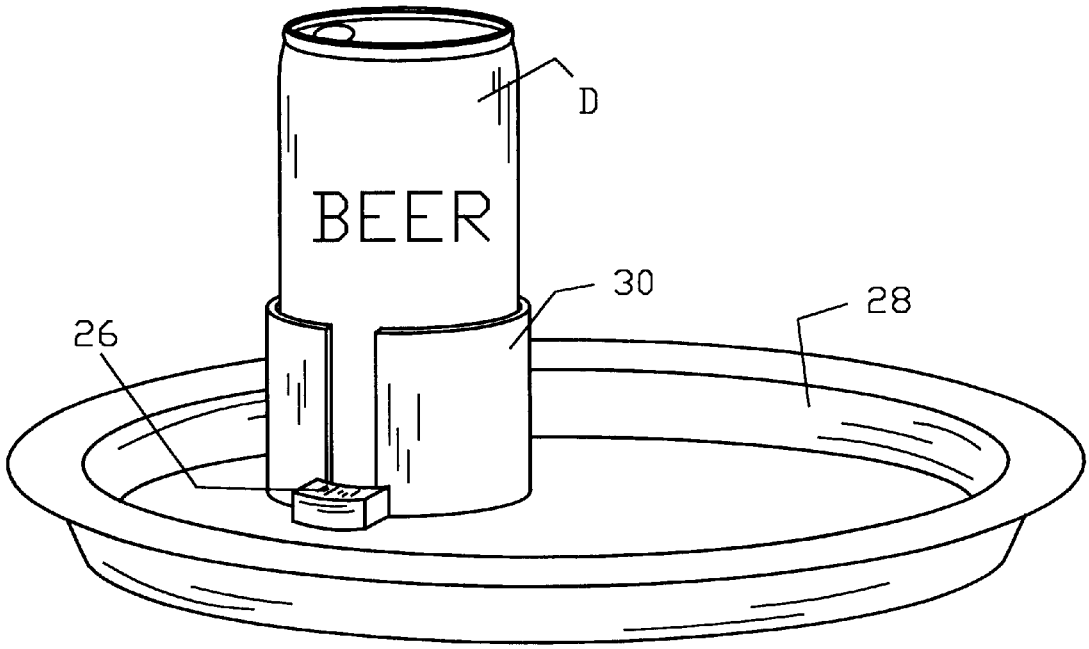
FIG. 2 is a perspective view of the drink vessel holder wherein the wall is a generally solid body.

Referring now to the drawings, it is seen that the drink vessel holder of the present invention, generally denoted by reference numeral 10, is comprised of a vessel holding member 12 that has a base 14 with a top 16 and a bottom 18 and a wall having an inner periphery 20, an outer periphery 22, and a slit 24. An extension 26 is attached to the base 14 and extends outwardly from the outer periphery 22 of the wall between end edges of the wall. The vessel holding member 12 receives an appropriate drink vessel D therein, such that the drink vessel D sits on the top 16 of the base 14, and the base 14 of the vessel holding member 12 rests on a plate 28 such that a person can hold the plate 28 while abutting a thumb T on the extension 26 for holding the vessel holding member 12 on the plate 28 which allows the person the hold the plate 28 and its contents along with the drink vessel holder 10 with its contents with one hand leaving the other hand free.

Figure 5:
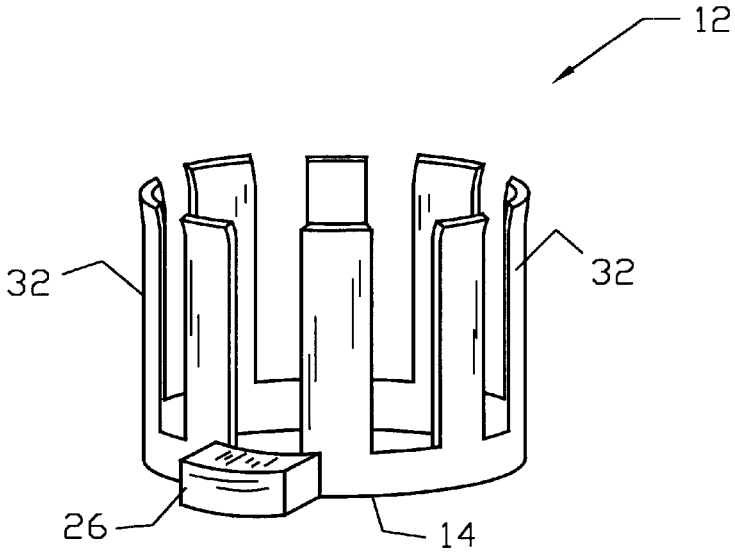
FIG. 5 is a close-up perspective view of the drink vessel holder of FIG. 4.
Figure 4:
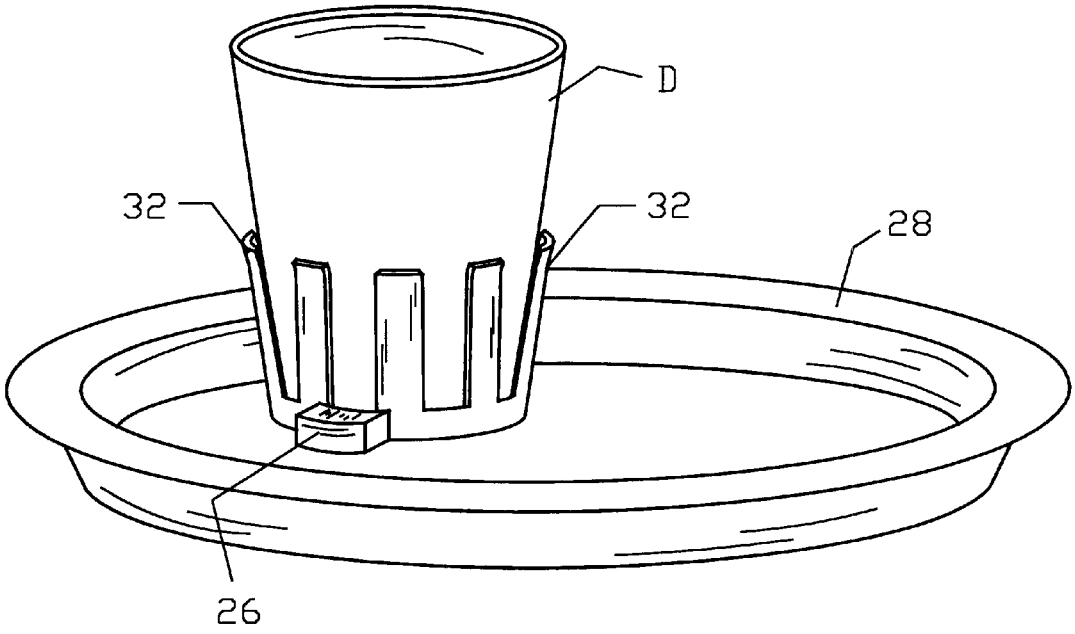
FIG. 4 is a perspective view of the wall wherein the vessel holding member comprises a plurality of fingers.
Figure 6:
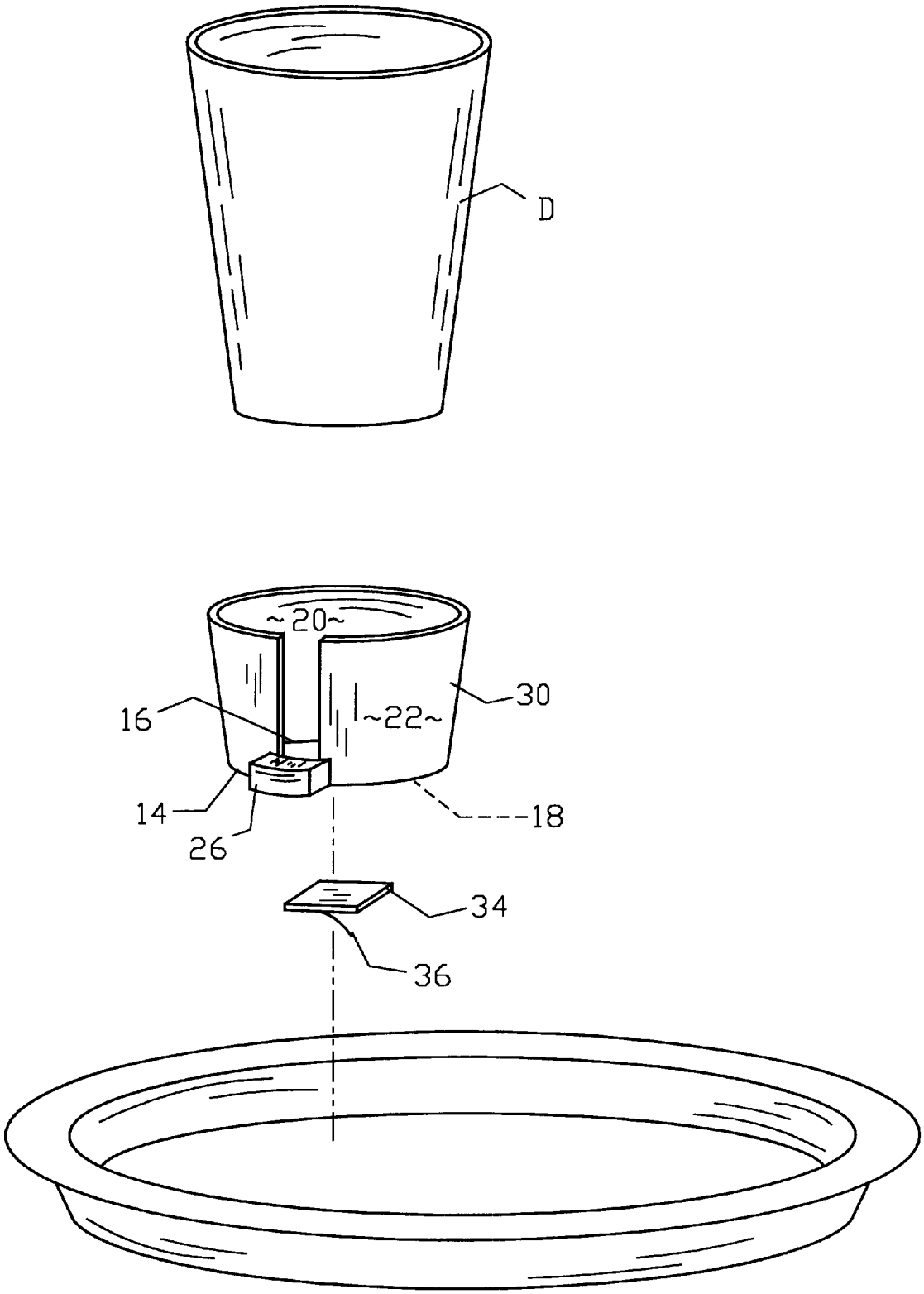
FIG. 6 is an exploded view of the drink vessel holder.

The extension 26 has a top surface that is generally concave for receiving the thumb T of the user. The wall is generally arcuate in shape and is either a generally solid body 30, as seen in FIGS. 1–3 and 6, extending from between a first side of the slit 24 and a second side of the slit 24 or is comprised of a plurality of fingers 32 extending upwardly from the top 16 of the base 14, as seen in FIGS. 4 and 5, wherein each of the plurality of fingers 32 is resilient.

The wall may taper inwardly extending from its top to the base 14. The wall, either as a generally solid body member 30 or as a plurality of fingers 32, can be dimensioned so as to rise to a sizable portion of the height of the drink vessel D that is held therein in, such as a can, a bottle or a drink glass, so that the wall provides support for the drink vessel D, or the wall may be relatively short wherein the wall provides only support to the base of the drink vessel wherein the drink vessel is a piece of stemware such as a wine glass. Furthermore, if the wall is comprised of a plurality of fingers 32, the vessel holding member 12 can be sized so that when the drink vessel D is being received within the vessel holding member 12, the individual fingers 32 deflect and thereafter act on the drink vessel D being held within the vessel holding member D in order to further help stabilize the drink vessel D thereat.

The vessel holding member 12 may be positioned on the plate 28 member off of the center of the plate 28. A dual sided adhesive member 34 can be located on the bottom 18 of the base 14 and can be covered by an appropriate cover member 36, such that when the vessel holding member is used, the cover member 36 is removed from the adhesive member 34 and the adhesive member 34 adheres the vessel holding member 12 to the plate 28. The peel strength of the adhesive member 34 is such that it holds the vessel holding member 12 to the plate 28 yet allows the vessel holding member 12 to be removed from the plate 28 with reasonable force.

The vessel holding member 12 can be made from any appropriate material such as metal, plastic, paper, etc.

If the plate 28 is relatively small, then the vessel holding member 12 can be positioned at approximately the center of the plate 28. However, if the plate 28 is relatively large, the vessel holding member 12 may be positioned off of the center of the plate 28 so that a user that is holding the plate 28 can easily position his thumb T so as to act on the drink vessel D being held within vessel holding member 12 in order to help secure the drink vessel D therein.

While the invention has been particularly shown and described with reference to embodiments thereof, it will be appreciated by those skilled in the art that various changes in form and detail may be made without departing from the spirit and scope of the invention.

I claim:

1. A drink vessel holder comprising:

a vessel holding member having a base with a top and a bottom and a wall having an inner periphery, an outer periphery, and a slit, an extension attached to the base and extending outwardly from the outer periphery and positioned below the slit; and wherein the vessel holding member is adapted to receive a drink vessel therein such that the drink vessel sits on the top of the base, and the base of the vessel holding member is adapted to rest on a plate such that a person can hold the plate member while abutting a thumb against the extension for holding the vessel holding member on the plate.

2. The drink vessel holder as in claim 1 wherein the extension has a top surface that is generally concave for receiving the thumb.

3. The drink vessel holder as in claim 1 wherein the wall is generally circular in shape.

4. The drink vessel holder as in claim 1 wherein the wall is a generally solid body extending from between a first side of the slit and a second side of the slit.

5. The drink vessel holder as in claim 1 wherein the wall is comprised of a plurality of fingers extending upwardly from the top of the base.

6. The drink vessel holder as in claim 5 wherein each of the plurality of fingers is resilient.

7. The drink vessel holder as in claim 1 wherein the wall is comprised from the group selected from a generally solid body extending from between a first side of the slit and a second side of the slit, or a plurality of fingers extending upwardly from the top of the base.

8. The drink vessel holder as in claim 7 wherein each of the plurality of fingers is resilient.

9. The drink vessel holder as in claim 1 wherein the wall tapers outwardly extending from the top of the base.

10. The drink vessel holder as in claim 1 in combination with the plate such that the bottom of the base rests on the plate.

11. The drink vessel holder as in claim 10 further comprising an adhesive member secured to the bottom of the base for adhesively securing the vessel holding member to the plate.

12. The drink vessel holder as in claim 10 wherein the vessel holding member is positioned on the plate off of the center of the plate.

13. The drink vessel holder as in claim 1 further comprising an adhesive member secured to the bottom of the base.

* * * * *